United States Patent [19]

Phillips

[11] Patent Number: 4,641,807

[45] Date of Patent: Feb. 10, 1987

[54] THREE-DIMENSIONALLY ADJUSTABLE PICTURE HANGER

[76] Inventor: Orville Phillips, 524 E. 20th St., #5D, New York, N.Y. 10009

[21] Appl. No.: 768,796

[22] Filed: Aug. 23, 1985

[51] Int. Cl.[4] ..... A47G 1/24

[52] U.S. Cl. ..... 248/480; 248/296; 248/493

[58] Field of Search ..... 248/480, 479, 493, 495, 248/476, 286, 287, 295.1, 296, 497; 40/617, 156, 153

[56] References Cited

U.S. PATENT DOCUMENTS

| | | | |
|---|---|---|---|
| 1,794,328 | 2/1931 | Simon . | |
| 1,848,064 | 3/1932 | Oishei | 248/480 |
| 2,723,096 | 11/1955 | Schwartz . | |
| 2,914,829 | 12/1959 | Willemain | 248/480 X |
| 3,188,028 | 6/1965 | Waller . | |
| 3,361,513 | 1/1968 | Pantazos | 248/480 X |
| 3,370,822 | 2/1968 | Miller | 248/476 |
| 3,709,585 | 1/1973 | Tsai | 248/480 X |
| 4,253,738 | 3/1981 | Linkous | 248/480 X |

FOREIGN PATENT DOCUMENTS

| | | | |
|---|---|---|---|
| 436682 | 11/1926 | Fed. Rep. of Germany | 248/495 |

*Primary Examiner*—J. Franklin Foss

*Attorney, Agent, or Firm*—Karl F. Milde, Jr.

[57] ABSTRACT

The picture hanger is adjustable in three dimensions to thereby adjust the suspension position up and down, side to side and inwardly and outwardly with respect to a mounting point. The hanger includes a body plate having an elongated slotted opening to receive a mounting screw at a mounting point upon a wall. A stud protrudes from the front surface of the body plate to provide the suspension support. The body plate is rotatable about the mounting point and translatable through movement over a screw at the mounting point at the slotted opening to thereby adjust the position of the stud at different suspension support positions.

10 Claims, 10 Drawing Figures

THREE-DIMENSIONALLY ADJUSTABLE PICTURE HANGER

BACKGROUND OF THE INVENTION

The precise positioning of a picture upon a wall is often very important. Furthermore, it is often difficult, on the first try, to place a picture hanger at exactly the correct picture suspension position. Accordingly, it is frequently necessary to make a second or third try at putting the hanger at the right position, even when the correct general position of the picture has already been definitely determined. This means that nails or screws must be fastened to the wall at new positions, resulting in substantial additional efforts, and unfortunately resulting in unnecessary defacement of the wall surface.

The extra effort required is particularly onerous where the wall is formed of masonry, requiring the drilling of several different mounting holes for the insertion of masonry screw anchors. With a hollow wall, where an expansion nut, such as a toggle wing nut, is inserted through the mounting hole, the problem is different. Not only must a new hole be made, but the toggle wing nut is lost within the hollow wall if the position is changed.

Furthermore, picture hangers are often used to hang objects other than pictures—such as clocks, plaques, specialty frames, and many other itmes. Often when used in varying capacities the support means of the hanger being used is either too close to the wall, or extended too far away from the wall to achieve the desired result.

Accordingly, it is an important object of the present invention to provide an adjustable suspension support position picture hanger which permits an exact adjustment of the suspension support position with respect to the original mounting point so as to substantially avoid the above-mentioned problems of positioning the picture hanger suspension support means at different mounting points and/or distances from the wall in order to obtain different suspension support positions.

Various structures have been devised to provide for vertical adjustment of hangers for items such as mirrors. For instance, see U.S. Pat. No. 2,723,096 issued on Nov. 8, 1955 to J. Schwartz, and U.S. Pat. No. 3,188,028 issued June 8, 1965 to A. Waller. Both of those arrangements involve relatively elaborate structures with screw-threaded height adjustments for the mirror or picture in relation to the supporting hook or structure. However, they do not provide any lateral adjustment capabilities. Vertical adjustments have been attempted also by means of simple hanger plate which are to be attached to the back of the picture which is to be hung. See U.S. Pat. No. 1,794,328 issued Feb. 24, 1931 to W. H. Simon. However, that arrangement also does not accommodate for any substantial horizontal adjustment, and requires the attachment of at least two special plates to the back of the picture, an undesirable complication.

Accordingly, it is a further object of the present invention to provide for an improved adjustable suspension support position hanger for objects such as pictures which is generally simpler than prior structures and which avoids the disadvantages of prior structures.

Further objects and advantages of the invention will be apparent from the following description and the accompanying drawings.

SUMMARY OF THE INVENTION

In carrying out the invention there is provided an adjustable suspension support position picture hanger which is adjustable in three dimensions to thereby adjust the suspension postion up and down, side to side, and inwardly and outwardly from the wall with respect to a mounting point comprising a body plate having a front surface and a rear surface, an elongated slotted opening in said body plate to receive a mounting screw at a mounting point upon a wall, a stud protruding from said front surface to provide the suspension support, said body plate being rotatable about the mounting point and translatable through movement over a screw at the mounting point at said slotted opening to thereby adjust the position of said stud at different suspension support positions.

DESCRIPTION OF PREFERRED EMBODIMENTS

Figure 1:
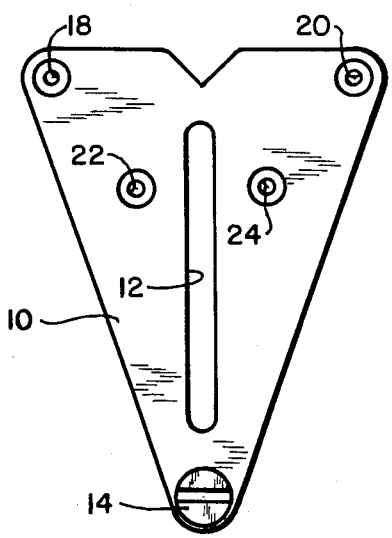
FIG. 1 is a front view of a preferred embodiment of the invention.

Referring more particularly to FIG. 1, there is shown a preferred embodiment of an adjustable suspension support position picture hanger. It comprises a body plate 10 having a front surface and a rear surface. The front surface of the body plate is shown in the drawing. The body plate 10 includes an elongated slotted opening 12 to receive a mounting screw at a mounting point upon a wall. A stud 14 is attached at the bottom of the body plate 10. The stud 14 preferably consists of a screw which which can be varied in length and which is attached in a threaded hole in the body plate 10.

Figure 2:
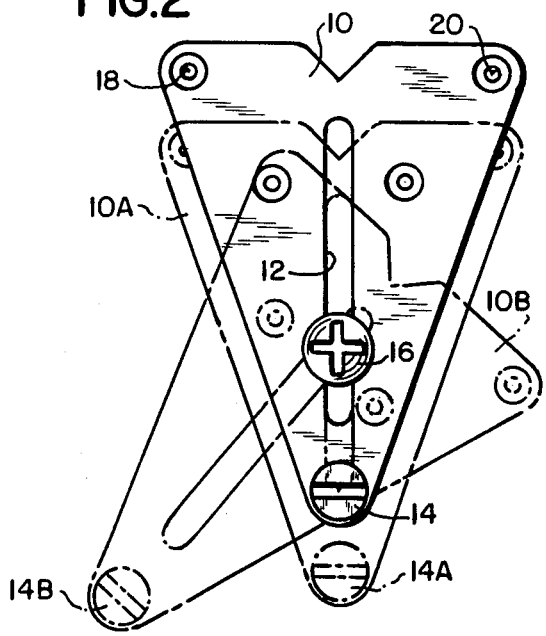
FIG. 2 is a view corresponding to FIG. 1 showing the preferred embodiment as mounted upon a wall, and showing in phantom how the position of the device may be changed in order to establish different suspension support positions.

FIG. 2 is a front view corresponding to FIG. 1, but showing how the device may be rotatable about a mounting point defined by a mounting screw 16 which extends through the slotted opening 12 into a wall upon which the device is mounted.

Two phantom representations of the device are indicated at 10A and 10B to illustrate how the suspension support position of the stud 14 can be changed by moving the mounting plate around upon the mounting point defined by mounting screw 16. Thus, as indicated in the phantom view 10A, the support position 14 may be moved downwardly to the point indicated at 14A, or the plate 10 may be rotated and moved downwardly and to the left on the slot 12 as indicated by phantom view 10B to adjust the suspension support position as indicated at 14B. Similarly, though not illustrated, the plate can be rotated to any position about the mounting point. Thus, for instance, the plate can be rotated to an inverted position or to a position extending diagonally upwardly, to achieve any position of the stud 14 above the mounting point within the range encompassed by the length of the slot 12. Therefore, it is apparent that great latitude is provided by this single device because of the possibility for movement vertically or laterally about the mounting screw 16. After the position is achieved, the screw 16 is tightened securely, thus locking the plate into the desired position.

Since the stud 14 is positioned near one end of the slotted opening 12, the device provides for a maximum adjustment in the position of the stud with respect to a mounting point as determined by a mounting screw 16 extending through the slot 12.

Referring back again to FIG. 1, auxiliary openings 18, 20, 22, and 24 are preferably provided in the plate to receive nails or screws for a nonadjustable fastening of the plate to the wall, if desired. The mounting plate preferably includes at least two of these openings 18–24 in a matched pair such as 18 and 20, or 22 and 24. Alternatively a matched pair can be threaded to receive a threaded stud to provide additional locations for fine adjustments of suspension supports.

Figure 3:
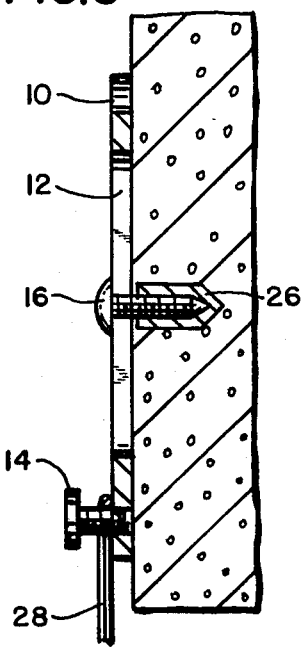
FIG. 3 is a sectional side view of the embodiment of FIG. 1 showing the device mounted upon a solid concrete wall.

FIG. 3 is a sectional side view of the embodiment of FIG. 1, showing the body plate 10 mounted upon a solid concrete wall by means of the screw 16, which is fitted into a conventional expansion sleeve 26. As indicated at 28, the picture hanger wire is looped over, and supported upon, the stud (screw) 14.

From the front aspect presented by FIG. 1, it is obvious that the device is substantially triangular in shape. This shape is preferred for aesthetic reasons, and also because the plate is better stabilized in position upon the wall because of its breadth transverse to the slot 12.

Thus, it is preferred to have the stud 14 near one corner of the body plate, with the elongated slotted opening 12 in substantial alignment with the stud 14 and extending through the center of the body plate to a position near the midpoint of the opposite side of the triangular shape of the body plate, as illustrated in FIG. 1. It is also preferred to have the additional mounting openings 18–24 positioned near the two remaining corners of the triangular shape of the body plate.

Figure 4:
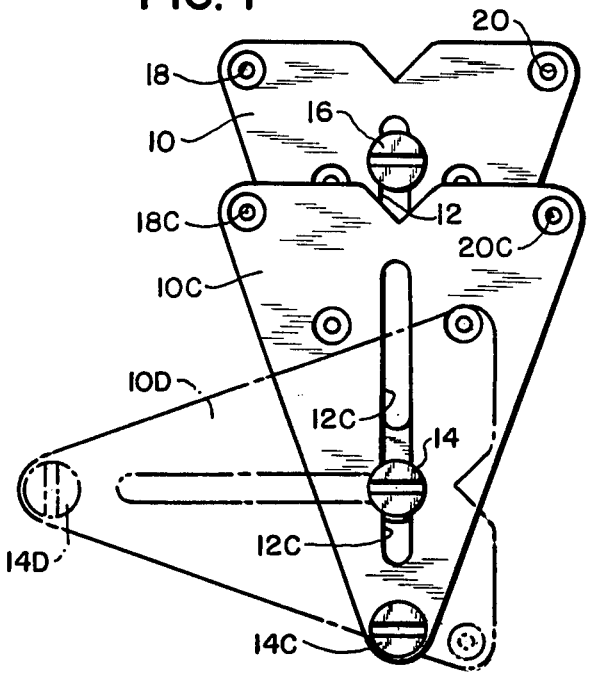
FIG. 4 illustrates how one of the devices of the present invention may be mounted upon and supported upon another identical device in order to achieve different suspension support positions, and showing in phantom the achievement of a substantial lateral position adjustment.

As illustrated in FIG. 4, where the adjustment of the suspension support position achievable by adjustment of a single mounting plate is insufficient, two of the devices may be used in conjunction with one another. The second plate 10C is mounted and supported upon the stud 14 of the first plate, the stud screw 14 extending through the slotted opening 12C of the second plate 10C. By this means, the position of the mounting stud 14C of the second plate 10C may be very substantially displaced from the original mounting point represented by screw 16. For instance, the second plate 10C may be rotated upon the stud 14, as indicated at 10D, to move the mounting stud 14C to the laterally displaced position 14D. In this manner, substantially increased position adjustments are available.

Alternatively, the first plate 10 may be nonadjustably attached to the wall, such as by means of fasteners fastened through the non-adjustable openings 18 and 20, and all of the adjustment may be provided by the adjustment of the second plate 10C upon the stud 14 of the first plate 10.

Figure 5:
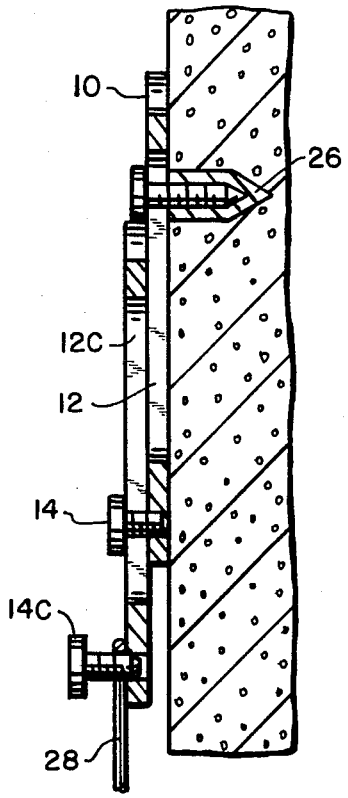
FIG. 5 is a sectional side view showing the combined devices of FIG. 4 as mounted upon a solid concrete wall.

FIG. 5 is a sectional side view of the assembly of FIG. 4, and shown as attached to a solid concrete wall by means of an expansion sleeve 26.

Figure 6:
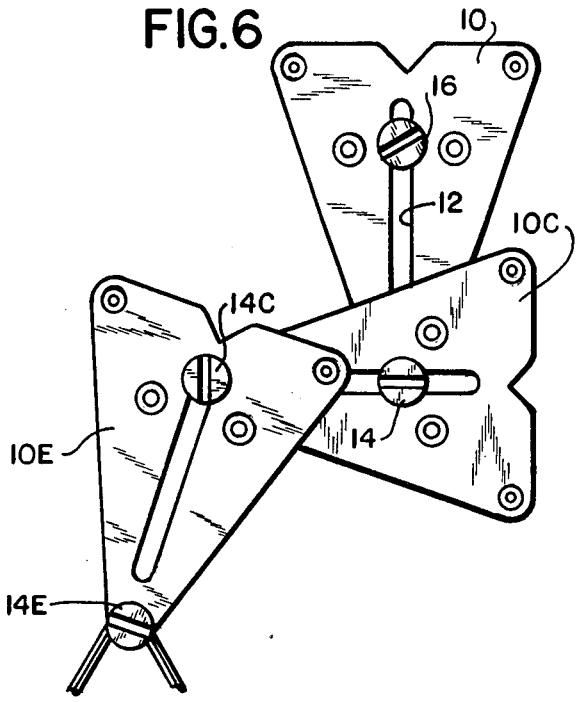
FIG. 6 shows how as many as three of the devices of the present invention may be combined in order to achieve a substantially extended adjustment of the suspension support position.

While not usually necessary, it is possible to employ still a third device 10E, as illustrated in FIG. 6. The third device 10E is supported upon the screw stud 14C of the second device 10C, which is, in turn, supported upon the screw stud 14 of device 10. The picture hanger wire is the looped over the screw stud 14E of the plate 10E.

Figure 7:
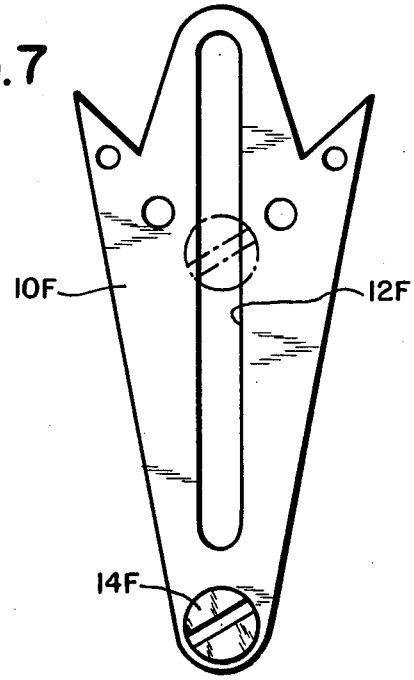
FIG. 7 is a front view, corresponding to the view of FIG. 1, illustrating a modified embodiment of the invention.

FIG. 7 illustrates still another modification of the invention including a plate 10F having a much longer screw slot 12F.

Figure 8:
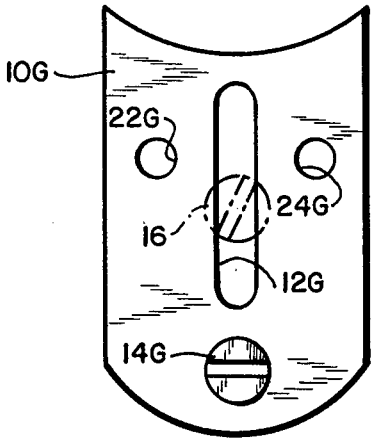
FIG. 8 is a front view corresponding to FIG. 1 and illustrating another modified embodiment of the invention.

FIG. 8 illustrates another modification of the invention in which the body plate 10G is simpler, and more nearly rectangular in shape, although including upper and lower curved marginal edges.

Figure 9:
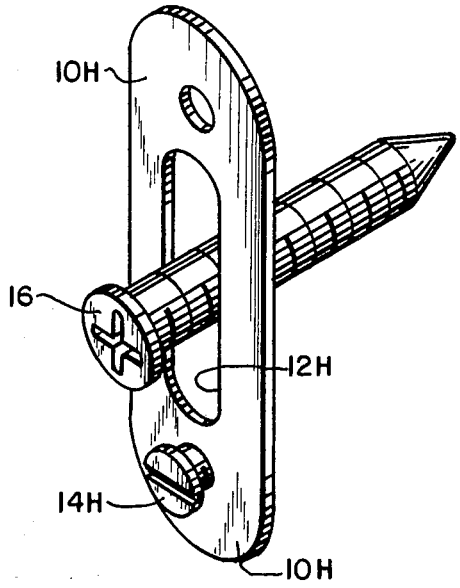
FIG. 9 is a perspective view of still another modified embodiment of the invention.

FIG. 9 illustrates still another modification of the invention including a plate 10H which is a simple narrow strip having a slotted opening 12H extending parallel to the narrow sides.

The embodiments of FIGS. 7, 8, and 9 operate in substantially the same manner as the embodiment of FIG. 1.

Figure 10:
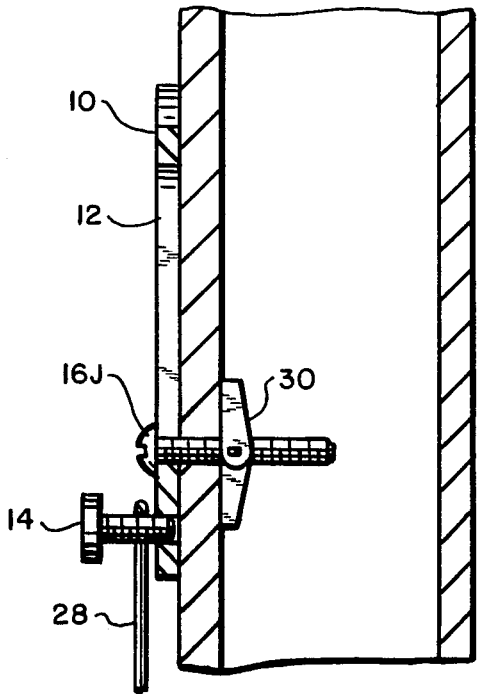
FIG. 10 is a sectional side view corresponding to FIG. 3, but showing how the device of the invention is preferably mounted upon a hollow wall.

FIG. 10 is a sectional side view corresponding to the sectional side view of FIG. 3, and showing how the device of FIG. 1 is mounted upon a hollow wall, using an expandable nut 30, which expands inside the hollow wall to form a secure purchase for the mounting screw 16J. In all other respects, the arrangement of FIG. 10 is like that of FIG. 3.

While the invention has been described entirely in terms of a picture hanging device, it will be obvious that the invention can be used to suspend other items from a mounting wall.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. An adjustable suspension support position picture hanger which is adjustable in three dimensions to thereby adjust the suspension position up and down, side to side and inwardly and outwardly with respect to a mounting point comprising: (1) a body plate having a front surface and a rear surface, having an elongated slotted opening to receive a mounting screw at a mounting point upon a wall, and having a stud protruding from said front surface to provide the suspension support for hanging a picture; and (2) a wall mounting screw, adapted to pass through said slotted opening in said body plate and to attach said body plate to a wall at said mounting point; said body plate being rotatable about said mounting screw and translatable through movement with respect to said mounting screw along said slotted opening to thereby adjust the position of said stud at different suspension support positions.

2. A hanger in accordance with claim 1 wherein said stud is formed by a threaded screw which is attached in a threaded opening in said body plate.

3. A hanger as claimed in claim 1 wherein said stud is positioned near one end of said elongated slotted opening in said plate so as to provide for a maximum adjustment in the position of said stud with respect to a mounting point.

4. A hanger as claimed in claim 3 wherein said body plate includes at least two additional threaded openings to accept a threaded stud for additional fine adjustment of suspension support positions.

5. A hanger as claimed in claim 1 wherein said body plate includes at least two additional mounting openings for mounting said plate upon a surface when adjustment in the position of said plate is not required.

6. A hanger as claimed in claim 5 wherein said mounting plate is substantially triangular in shape.

7. A hanger as claimed in claim 2 which comprises an assembly of at least two of said body plates, the screw stud of a first one of said body plates serving as a mounting point screw extending through the elongated slotted opening of a second one of said body plates, said second body plate being adjustable in position with respect to said mounting point formed by said stud screw of said first plate.

8. A hanger as claimed in claim 6 wherein said protruding stud is positioned near one corner of said body plate and wherein said elongated slotted opening is in substantial alignment with said stud and extends from a position near said stud through the center of said body plate to a position near the midpoint of the opposite side of the triangular shape, said body plate including at least two additional mounting openings, and said two additional mounting openings being positioned respectively near the two remaining corners of said triangular shape of said body plate.

9. A hanger as claimed in claim 3 wherein said stud is positioned at one end of said slot and in substantial alignment with said slot.

10. A hanger as claimed in claim 7 which comprises an assembly including at least a third body plate, the screw stud of said second one of said body plates serving as a mounting point screw extending through the elongated slotted opening of said third one of said body plates, said third body plate being adjustable in position with respect to said mounting point formed by said stud screw of said second plate.

* * * * *